US006773516B2

(12) United States Patent
Hardin et al.

(10) Patent No.: US 6,773,516 B2
(45) **Date of Patent: *Aug. 10, 2004**

(54) PROCESS AND SOLUTION FOR PROVIDING A CONVERSION COATING ON A METALLIC SURFACE I

(75) Inventors: Simon Gerard Hardin, North Fitzroy (AU); Klaus Werner Wittel, Frankfurt (DE); Anthony Ewart Hughes, Olinda (AU); Karen Joy Hammon Nelson, Plympton (AU)

(73) Assignee: Commonwealth Scientific and Industrial Research Organisation (AU)

( * ) Notice: Subject to any disclaimer, the term of this patent is extended or adjusted under 35 U.S.C. 154(b) by 37 days.

This patent is subject to a terminal disclaimer.

(21) Appl. No.: 09/988,578

(22) Filed: Nov. 20, 2001

(65) Prior Publication Data

US 2002/0084002 A1 Jul. 4, 2002

Related U.S. Application Data

(63) Continuation of application No. PCT/AU01/00311, filed on Mar. 20, 2001.

(30) Foreign Application Priority Data

Mar. 20, 2000 (AU) ..... PQ6332

(51) Int. Cl.[7] ..... C23C 22/00

(52) U.S. Cl. ..... 148/243; 148/272; 148/273; 148/275; 106/14.21; 252/387

(58) Field of Search ..... 148/243, 272, 148/273, 275; 106/14.21; 252/387

(56) References Cited

U.S. PATENT DOCUMENTS

| | | | | |
|---|---|---|---|---|
| 3,969,152 | A | 7/1976 | Melotik | 148/6.15 |
| 4,233,088 | A | 11/1980 | Kronstein | 148/6.16 |
| 4,264,278 | A | 4/1981 | Weingart | 416/226 |
| 4,298,404 | A | 11/1981 | Greene | 148/6.14 |
| 4,310,390 | A | 1/1982 | Bradley et al. | 204/37 |
| 4,349,392 | A | 9/1982 | Huvar | 148/6.2 |
| 4,359,347 | A | 11/1982 | Da Fonte, Jr. | 148/6.14 |
| 4,610,732 | A | 9/1986 | Sasaki et al. | 148/6.14 |
| 4,711,667 | A | 12/1987 | Bibber | 106/14.2 |
| 4,725,375 | A | 2/1988 | Fujii et al. | 252/79.4 |
| 4,755,224 | A | 7/1988 | Bibber | 106/14.2 |
| 4,851,148 | A | 7/1989 | Yamasoe et al. | 252/142 |
| 4,878,963 | A | 11/1989 | Bibber | 148/262 |
| 4,883,541 | A | 11/1989 | Tadros | 134/3 |
| 4,921,552 | A | 5/1990 | Sander et al. | 148/247 |
| 4,944,889 | A | 7/1990 | Awad | 252/32.5 |
| 4,988,396 | A | 1/1991 | Bibber | 148/269 |
| 5,030,323 | A | 7/1991 | Awad | 156/665 |
| 5,080,814 | A | 1/1992 | Awad | 252/49.3 |
| 5,118,356 | A | 6/1992 | Darmon et al. | 134/3 |
| 5,192,374 | A | 3/1993 | Kindler | 148/272 |
| 5,194,138 | A | 3/1993 | Mansfeld et al. | 205/183 |
| 5,198,141 | A | 3/1993 | Darmon et al. | 252/142 |
| 5,221,371 | A | 6/1993 | Miller | 148/273 |
| 5,356,492 | A | 10/1994 | Miller | 148/273 |
| 5,356,942 | A | 10/1994 | Savoca et al. | 521/103 |
| 5,362,335 | A | 11/1994 | Rungta | 148/272 |
| 5,383,982 | A | 1/1995 | Hauffe et al. | 148/262 |
| 5,389,199 | A | 2/1995 | Awad et al. | 156/665 |
| 5,520,750 | A | 5/1996 | Riley | 148/261 |
| 5,584,943 | A | 12/1996 | Banaszak et al. | 148/246 |
| 6,022,425 | A | 2/2000 | Nelson et al. | 148/272 |
| 6,206,982 | B1 | 3/2001 | Hughes et al. | 148/273 |
| 6,503,565 | B1 | 1/2003 | Hughes et al. | 427/299 |

FOREIGN PATENT DOCUMENTS

| | | |
|---|---|---|
| AU | 24808/84 | 2/1984 |
| AU | 22855/92 | 3/1993 |
| EP | 0127572 | 12/1984 |
| EP | 0331284 | 9/1989 |
| EP | 0367504 | 5/1990 |
| EP | 0486778 | 5/1992 |
| EP | 0488430 | 6/1992 |
| EP | 0603921 | 6/1994 |
| EP | 0694593 | 1/1996 |
| EP | 0760401 A1 | 3/1997 |
| EP | 0769080 | 9/2000 |
| GB | 1368230 | 9/1974 |
| GB | 2059445 | 4/1981 |
| GB | 2097024 A | 10/1982 |
| WO | WO88/06639 | 9/1988 |
| WO | WO95/08008 | 3/1995 |
| WO | WO95/34693 | 12/1995 |
| WO | WO96/11290 | 4/1996 |
| WO | WO96/15292 | 5/1996 |
| WO | WO99/46422 | 9/1999 |

OTHER PUBLICATIONS

Chemical and Engineering News, 63 (5), 27, 1985 Periodic Table.

139 Galvanotechnik 85 (1994), Jun. No. 6, Saulgau (Wurtt.), DE Abstract, no month data.

Arnott et al, Applns of Surface Science 22/23, 1985, pp. 236–251, Auger and XPS Studies of Cerium Corrosion Inhibition. . ., no month data.

King, Surface Treatment and Finishing of Aluminum, Chapter 6, 1988, pp. 51–58, Conversion Coatings as Pretreatments for. . ., no month data.

Abstract, Bibber, Corrosion resistant vonversion coating prepn. for aluminum alloys—by typically treating alloy with. . ., no month data.

*Primary Examiner*—Andrew L. Oltmans
(74) *Attorney, Agent, or Firm*—Jacobson Holman PLLC

(57) ABSTRACT

An aqueous acidic solution for forming a rare earth element containing conversion coating on the surface of a metal, said solution being chromate-free and including effective quantities of at least one rare earth element (as herein defined) containing species, an oxidant and at least one accelerator, comprising a metal selected from Groups VA and VIA of the Periodic Table.

23 Claims, No Drawings

PROCESS AND SOLUTION FOR PROVIDING A CONVERSION COATING ON A METALLIC SURFACE I

This is a continuation application of PCT/AU01/00311, filed Mar. 20, 2001, and published in English.

FIELD OF THE INVENTION

This invention relates to a surface treated part with a conversion coating formed on a metallic surface and to a process for forming this conversion coating, to a liquid aqueous concentrate for the make-up or for the replenishing of a conversion coating solution as well as to a solution for forming a conversion coating on surfaces of metallic materials. The invention is particularly concerned with a conversion coating on aluminum, aluminum alloy, magnesium, magnesium alloy, zinc or zinc alloy and a process, a concentrate and a solution for the formation of a conversion coating on parts of these metallic materials.

BACKGROUND OF THE INVENTION

The term "conversion coating" is a well known term of the art and refers to the replacement of native oxide on the surface of a metallic material by the controlled chemical formation of a film. Oxides, chromates or phosphates are common conversion coatings. Conversion coatings are used on metallic materials such as steel or aluminum, zinc, cadmium, magnesium and their alloys, and provide a key for paint adhesion and/or corrosion protection of the metallic substrate. Accordingly, conversion coatings find application in such areas as the aerospace, automotive, architectural, can stock, instrument and building industries.

Known methods for applying conversion coatings to metallic surfaces include treatment with chromate or phosphate solutions, or mixtures thereof. However, in recent years it has been recognized that the hexavalent chromium ion, $Cr^{6+}$, is a serious environmental and health hazard. Similarly, phosphate ions are a considerable risk, particularly when they find their way into natural waterways and cause algal blooms. Consequently, strict restrictions have been placed on the quantity of these species used in a number of industrial processes and limitations have been placed on their release to the environment. This leads to costly effluent processing.

In the search for alternative, less toxic conversion coatings, research has been conducted on conversion coatings based on rare earth compounds. However, there is considerable room for improvement in the adhesion and corrosion protection properties of prior rare earth element (hereinafter referred to as "REE") based conversion coatings and in the time required to deposit those coatings. The need for improvement is particularly true for conversion coatings on certain metal alloys, such as 3000, 5000 and 6000 series aluminum alloys, which coatings can be slow to deposit and have variable adherence or no adherence.

WO 88/06639 teaches a process for forming a conversion coating on metal using a cerium containing conversion coating solution. However, it has been found that said process does not produce acceptable coatings within the time needed for industrial coating, that means within much less than five minutes.

WO 96/15292 describes a REE containing conversion coating and a process for its formation using a solution containing REE, and additives selected from (i) metal peroxo complexes in which the metal is selected from Groups IVB, VB, VIB and VIIB; and (ii) metal salts or complexes of a conjugate base of an acid in which the metal is selected from Transition Elements other than chromium, especially copper, silver, manganese, zinc, iron, ruthenium, and Group IVA elements, especially tin. The solution preferably also includes hydrogen peroxide. Good results were obtained using the additive Cu alone or in combination with Mn, Ti-peroxo complexes and/or Mo peroxo complexes. However, it has been found that such a composition leads to a significant decomposition of the peroxidic compound. Furthermore, the use of two different accelerators creates difficulties in controlling the process particularly when it is used on an industrial scale. In all the other examples disclosed in WO96/15292, a time for applying the solution was needed which was much longer than the typical times required in current industrial practice, i.e. from about 1 to 3 minutes.

Over the years there have been numerous attempts to replace chromate-based chemicals by ones less hazardous to health and the environment. The proposed alternatives suffer from the disadvantages of either forming colorless conversion coatings—for example Gardobond 764®, which is based on zirconium fluoride—or requiring very long treatment times, such as the chemical oxidation process described in EP-A-0 769 080. Zirconium and titanium based conversion coating processes have found some applications in certain market niches, but they have failed in the past 25 years to replace chromate based solutions as a pre-treatment prior to painting of aluminum, magnesium, zinc or their alloys.

Accordingly, it is an object of the present invention to provide a conversion coating for the surface of a metallic material which overcomes, or at least alleviates, one or more of the disadvantages or deficiencies of the prior art. It is also an object of the present invention to provide an aqueous, rare earth element containing conversion coating solution for use in providing a conversion coating on a metallic surface. It is a further object to provide a process for forming the conversion coating on the metallic surface.

It has been discovered that the addition of one or more additives, having particular compositions, to the coating solution can assist in accelerating the coating process and/or improving adhesion of the conversion coating to the metal surface. Such coating solutions have the advantages of forming conversion coatings in a short period of time as required in industrial applications, and having a low rate of decomposition of peroxidic composition solution.

Throughout the specification, reference will be to the CAS version of the Periodic Table, as defined in (for example) Chemical and Engineering News, 63(5), 27, 1985. Furthermore, as used herein, the term "rare earth" elements, metals or ions, or "REE" refers to the elements of the Lanthanide series, namely those having the atomic number 57 to 71 (La to Lu), plus scandium and yttrium. Moreover, as used herein, the term "peroxidic compound" refers to any of the group of peroxo acids and their salts or any peroxo containing compound such as hydrogen peroxide. Also, the expression: "metal selected from Groups VA and VIA of the Periodic Table" is intended to cover both metals and metalloids of Groups VA and VIA, namely As, Sb, Bi, Se, Te and Po. Further, the generic term "part" is intended to cover any body or component of any shape or size having at least one metallic surface thereon.

SUMMARY OF THE INVENTION

According to the present invention, there is provided an aqueous, acidic solution for forming a rare earth element containing conversion coating on the surface of a metal, said solution being chromate-free and including effective quantities of at least one rare earth element (as herein defined) containing species, an oxidant and at least one accelerator, comprising a metal selected from Groups VA and VIA of the Periodic Table.

According to the present invention, there is also provided a process for forming a conversion coating on the surface of a metallic material including contacting said surface with an aqueous, acidic conversion coating solution containing at least one rare earth element (as herein defined) containing species and a peroxidic species, said solution including at least one accelerator, comprising a metal selected from Groups VA and VIA of the Periodic Table, wherein the solution is essentially free of chromate.

The present invention also provides a surface treated part including a metallic material having a conversion coating thereon resulting from treatment with the aqueous, acidic conversion coating solution of the invention. The treated part may additionally bear a coating of a paint, a lubricant and/or a sealant. The treated part may be subsequently used in a process involving cold forming, glueing, welding and/or other joining processes. The conversion coating preferably contains at least 5% by weight of a rare earth compound.

The aqueous, acidic conversion coating solution also preferably contains a chloride containing species, such that the concentration of chloride in solution is at least 50 mg/l. This is particularly preferred where the metallic surface comprises aluminium or an aluminium alloy. The conversion coating preferably contains at least 5% by weight of a rare earth compound and the treated part may additionally bear a coating of a paint, a lubricant and/or a sealant.

The present invention further provides a liquid acidic aqueous concentrate for the make-up of a conversion coating solution according to the invention, wherein the concentrate contains at least 80 g/l of at least one rare earth element (as herein defined) containing species and at least one acid selected from the group of mineral acids, carboxylic acids, sulphonic acids and phosphonic acids, and wherein the concentrate contains essentially no chromate.

Furthermore, the present invention provides a liquid acidic aqueous concentrate for the replenishing of a conversion coating solution according to the invention, wherein the concentrate contains REE ions and monovalent anions in a molar ratio of total REE ions:monovalent anions of from 1:200 to 1:6 and/or the concentrate contains REE ions and divalent anions in a molar ratio of total REE ions:divalent anions of from 1:100 to 1:3 and/or the concentrate contains at least one metal selected from Groups VA and VIA of the Periodic Table, wherein the molar ratio of said metal:monovalent anions is in the range 1:100 to 1:20000 or the molar ratio of said metal:divalent anions is in the range 1:50 to 1:10,000.

DETAILED DESCRIPTION OF THE PREFERRED EMBODIMENTS

It has been discovered that the addition of a metal from Groups VA and VIA, especially of bismuth, and the addition of at least one rare earth element (REE), a complexing agent such as hydroxyethylethylene-diaminetriacetic acid (HEDTA), any oxidant like hydrogen peroxide, and chloride to an aqueous acidic conversion coating solution results within short time in very homogeneous, dense, conversion coatings with good adherence to the substrate and good corrosion resistance.

Surprisingly it was found that the process of the invention can work without a considerable loss of the peroxidic compound(s) added and that the corrosion of the stainless steel in contact with the conversion coating solution can be limited to practically, zero, if the chloride content is relatively low. Furthermore, it is an advantage of the process of the invention that only one cation besides REE need be added in order to produce an effective conversion coating solution, compared with the prior art which required the addition of a combination of cations which has to be controlled carefully.

The invention will now be described with particular reference to its use for aluminum, aluminum alloys, magnesium, magnesium alloys, zinc or zinc alloys. In particular, the metallic materials to be primarily discussed in the following are aluminum and aluminum alloys, particularly aluminum alloys of the 3000, 5000 and 6000 series. However, a skilled addressee will understand that the invention is not limited to this use and can be used in relation to other metallic materials, such as steel.

The surface treated part of the present invention may exist in any shape, such as tubes, wires, sheets, ingots, profiles or coils.

The conversion coating step may form part of an overall metal treatment process which may include one or more of the following steps:

cleaning, preferably with an aqueous, alkaline cleaner,
pickling, usually in a strongly alkaline solution,
deoxidizing, usually in an acidic solution,
conversion coating,
final rinsing, preferably with de-ionized water and/or special sealants.

All of these steps should preferably be separated by one or more steps of rinsing with water thus reducing carry-over of processing chemicals into the next treatment stage. Accordingly, the conversion coating process may comprise at least one of at least two successive treatments, including passivation treatments.

The pickling may be done with an alkaline solution, such as one containing caustic soda solution and a gluconate. The deoxidizing/desmutting may be carried out with an acidic solution, such as containing nitric acid and hydrofluoric acid or containing hydrofluoric acid and phosphoric acid or containing sodium bifluoride or containing $Fe^{3+}$ and sulphuric acid or containing $Fe^{3+}$ and nitric acid.

Considering the demand of a chromate-free conversion coating, standard chromate containing deoxidizers would not be recommended for use in a process according to this invention. Another, relatively new possibility is the use of a REE based deoxidizer as described in WO 95/08008 A1.

If the steps of cleaning, pickling and deoxidizing are used, a clean metallic surface is prepared, free from dirt, oil and greases, as free as possible from oxides, and therefore very reactive towards the conversion coating step itself. The specific chemistry and process conditions will depend very much on the state of the metal surface which is to be treated. A heavily oxidized aluminum surface, for instance, certainly will require a pickling step to remove the thick oxide layer from the surface.

The conversion coating solution forms a thin layer on the metallic surface. The corrosion protecting properties of this coating may be further improved by adding a sealant to the final rinsing solution. Suitable sealants may be based on silicates, phosphates, silanes, fluorobtanates or fluorozirconates, special polymers like polyvinylphenole derivatives or, sometimes modified, polyacrylates. As with the deoxidizer, the well-known chromate containing sealants could be used in principle, yet may be undesirable in an otherwise chromate-free process.

The conversion coating solution may contain ions and/or at least one complex species of one or a mixture of REE. There may be a REE distribution which results from the natural raw materials used, such as that of misch-metal. Alternatively a refined fraction of REE may be used, e.g. cerium with a purity of greater than 95%. The ratio of cerium to total REE may be at least 5% by weight, preferably at least 30% by weight, particularly preferred at least 60% by weight.

Throughout the specification, unless otherwise specified, the values of concentration of rare earth ions in g/l are usually expressed as the molar equivalent grams of cerium per liter of solution.

The coating solution may contain ions and/or at least one complex species of (REE) in a concentration ranging from smallest additions to the solubility limit. The concentration is preferably in the range of from 0.5 to 1000 g/l of REE, more preferred from 0.5 to 100 g/l, more preferred from 1 to 60 g/l of REE, particularly preferred 2 to 30 g/l of REE. In the case where very short treatment times are required, e.g. 1 to 20 seconds, there may be the need to have a higher REE content such as in a range of from 120 to 600 g/l, preferably in the range of from 150 to 240 g/l. In other embodiments, the rare earth ion and/or complex is typically present in the coating solution at a concentration below 50 g/l, such as up to 40 g/l or up to 38 g/l. More preferably, this concentration is below 32 g/l. The preferred lower concentration limit may be above 0.038 g/l, such as 0.38 g/l or even 3.8 g/l and above. In a particularly preferred embodiment, the solution contains up to 0.6 mol/l of cerium, preferably of from 0.01 to 0.5 mol/l of cerium, preferably of from 0.05 to 0.4 mol/l of cerium especially preferred as cerium chloride. Nevertheless, a lower content of the REE is preferred in many cases because of costs.

It is further particularly preferred that the cerium be present in the solution as $Ce^{3+}$ cations and/or complexes. While not wishing to be restricted to a particular mechanism of reaction, it is believed that when the metallic surface is reacted with the coating solution, the resulting pH values increase at the metallic surface, which indirectly results in a precipitation of a cerium (IV) containing compound on the metallic surface. There may be transiently formed one or more peroxidic compounds of cerium in solution from interaction of cerium ions with the peroxidic compound. The cerium may be present in part, in the solution as $Ce^{4+}$, as the $Ce^{3+}$ may be oxidized in the presence of the peroxidic compound. Cerium may be precipitated in the conversion coating as hydroxide, oxide, peroxide, or salt, preferably as a cerium (IV)-compound. Generally, yellowish to orange coatings can be found when using cerium compounds, whereby the color depends of the thickness of the coating. A certain cerium content and/or content of at least one other REE creating a colored conversion coating like Pr, Nd, Sm, Eu, Tb, Dy, Ho, Er, and Tm, or their mixtures may be preferred to be able to control the quality of the formed conversion coating visually.

It is particularly preferred that the REE be introduced into the coating solution in the form of a soluble salt, such as a cerium (III) containing chloride, cerium (III) containing sulphate, cerium (III) containing sulphamate, cerium (III) containing methanesulphonate, cerium (III) containing perchlorate or cerium (III) containing nitrate.

The REE may be introduced into the conversion coating solution by dissolving any REE containing compound or metal or any mixture of these in any acid or acid mixture. Preferably, the REE containing compound is a metal, alloy, oxide, hydroxide or carbonate which may be dissolved in an acid like hydrochloric acid or in a mixture of acids. Particularly preferred starting materials are mischmetal, cerium containing oxides, cerium containing hydroxides and cerium containing carbonates.

The conversion coating solution preferably contains up to 1.2 g/l of the accelerator comprising one or more metals of Groups VA and VIA of the Periodic Table. Preferably, the Group VA metal is selected from Sb and Bi and the Group VIA element is selected from Se and Te. Of these elements, Sb and Bi are more preferred, with Bi being the most preferred. The concentration of this at least one element of this group may be in the range of from 0.001 to 1 g/l, preferably from 0.005 to 0.2 g/l, more preferably of from 0.005 to 0.1 g/l, more preferably from 0.01 to 0.1 g/l, particularly preferred of from 0.01 to 0.06 g/l. The solution may contain one or more of these elements. However, it is an advantage of the invention that only one of these metals need be added to solution in order to obtain an effective conversion coating solution which exhibits both accelerated coating and improved adhesion with low decomposition of $H_2O_2$. The total concentration of the elements from this group may be up to 50 mmol/l, preferably 0.001 to 20 mmol/l, more preferably 0.01 to 20 mmol/l. Particularly preferred is Bi in a concentration range of from 0.02 to 5 mmol/l. This addition functions as an accelerator although the details of the influence of these elements are not yet fully understood. Nevertheless, a lower content of this addition is preferred in many cases in order to reduce costs.

The coating solution may optionally contain a further additive, such as metal-peroxo complex, e.g. a Ti-peroxo species, in addition to the accelerator from Group VA or VIA. The use of metal peroxo additives is described in WO96/15292, as one of two possible classes of accelerators. However, the present solution performs quite satisfactorily with only the one accelerator from Group VA or VIA and it is preferred to add only that one accelerator, in order to simplify the composition of the coating solution and minimise cost.

The conversion coating solution contains at least one oxidant, preferably any peroxidic compound of the group of peroxo acids, their salts or any peroxo compound. The oxidant is preferably hydrogen peroxide as there are no environmental risks associated with the use of hydrogen peroxide. The coating solution may contain up to 200 g/l of hydrogen peroxide or equivalent molar amounts of any peroxidic compound—calculated as hydrogen peroxide. The concentration is preferably of from 1 to 100 g/l, particularly preferred of from 2 to 50 g/l or even more preferably of from 6 to 28 g/l. The solution may contain up to 10 mol/l of hydrogen peroxide or equivalent amounts of any peroxidic compound, preferably of from 0.01 to 6 mol/l, particularly preferred of from 0.1 to 1 mol/l. Nevertheless, a lower content of the peroxidic compound is preferred in many cases because of costs.

The conversion coating solution may contain at least one complexing agent which complexes and/or is already complexed with the one or more elements selected from Groups VA and VIA. A stable complex is required. Preferably the complexing agent is/are selected from the group of amino carboxylic acids, more preferably polyamino carboxylic acids, and their corresponding salts, such as glycine, alanine and/or glycinethyl ester. Particularly preferred complexing agents are ethylenediaminetetraacetic acid (EDTA), nitrilotriacetic acid (NTA), hydroxyethylethylenediaminetriacetic acid (HEDTA) and/or their corresponding salts The solution may contain at least one complex with EDTA, NTA or HEDTA and/or its salts up to 50 mmol/l, preferably in a range of from 0.01 to 20 mmol/l.

The complexing agent has been found to be beneficial in preventing precipitation of the additive element from the coating solution, in particular the precipitation of Bi, thereby enhancing the effective life of the solution.

The complexing agents EDTA, NTA and HEDTA are preferred as they form very stable complexes. The molar concentration ratio of complexing agent element of the group Sn, Pb, Sb, Bi, Se and Te is preferably 4:1 to 0.8:1 for EDTA and/or HEDTA and of 8:1 to 2:1 for NTA, particularly preferred of 2:1 to 0.9:1 for EDTA and/or HEDTA and of 4:1 to 2.4:1 for NTA, especially of about 1:1 for EDTA and/or HEDTA and of about 3:1 for NTA. HEDTA is the favoured complexing agent as it is the least toxic of the group.

Even a small content of such a complex in the range near e.g. 0.1 mmol/l is beneficial. The conversion coating solution additives selected from Groups VA and VIA can enhance the coating adhesion to and/or rate of coating on the metallic surface. It is particularly preferred to have a small excess of complexing agent over the compounds and complexes containing the at least one element from Groups VA and VIA.

It is preferred not to add the complexing agent and any compound containing the at least one element from Groups VA and VIA separately, but to add at least one complex species containing such element(s), previously formed, as the complex species containing such element(s) may be slow to form in dilute solution.

The conversion coating solution should preferably have no or minimal concentrations of Cu, Fe, Ni and/or Co. The presence of these elements can cause a higher and more expensive consumption of the peroxidic compound(s), as they can influence the peroxide stability in the solution, leading to further additions of the peroxidic compound(s) being required. These elements may accumulate in the solution as a result of being dissolved from the surface of the metallic material. Therefore, it is preferred to avoid the intentional addition of significant amounts of Cu, Fe, Ni and Co. For example, the presence of sufficient Cu in solution leads to an ongoing effervescence (bubbling) of oxygen and the formation of further water from the peroxidic compound which can cause a loss of e.g. 25% by weight of the peroxidic compound per day. Moreover, it is preferred to avoid an addition of any alcohol, sulphide or other compounds readily decomposed by peroxidic compounds.

Nevertheless, the process of the invention is suitable for conversion coating solutions which are substantially stable or acceptably unstable with respect to the decomposition of the peroxidic compound(s). Therefore, this process may be successfully used for alloys including as alloying components, Cu or Fe which are dissolved into the coating solution at a concentration of e.g. 1 or 5 mg/l. In such a solution, the loss of peroxidic compound may be in the range of about 0.1 to about 5% by weight per day.

Preferably, the conversion coating solution contains of from 0.5 to 800 g/l of at least one REE, 1 to 120 g/l of any peroxidic compound and 1 to 500 mg/l of at least one metal from Groups VA and VIA. The solution more preferably contains from 1 to 40 g/l of at least one REE, 2 to 35 g/l of any peroxidic compound and 2 to 200 mg/l of at least one metal from Groups VA and VIA, especially a mixture of rare earth elements with a cerium content, hydrogen peroxide and/or bismuth.

Preferably, the conversion coating solution contains of from 0.03 to 0.3 mol/l of at least one REE, 0.05 to 1.2 mol/l of any peroxidic compound and 0.01 to 1.0 mmol/l of at least one metal from Groups VA and VIA, especially a mixture of rare earth elements with a cerium content, hydrogen peroxide and/or bismuth.

The pH value of the solution may be adjusted by at least one acid selected from the group of mineral acids, carboxylic acids, sulphonic acids and phosphonic acids. Preferably the acid is selected from the group of hydrochloric acid, nitric acid, perchloric acid, sulphuric acid, methanesulphonic acid and sulphamic acid. The acid should preferably not be hydrofluoric or phosphoric acid, because of the restriction on fluoride and phosphate concentration in solution. The pH value of the conversion coating solution may be adjusted to values of from 1 to 2.9. The solution may have a pH value of from 1.7 to 2.5, preferably of from 1.9 to 2.2, more preferably 1.8 to 2.2, especially adjusted with hydrochloric acid or with a mixture of acids containing hydrochloric acid. It is generally not sufficient to generate the acidic state only by the dissolution of a cerium salt, e.g. cerium chloride, but is typically necessary to add an acid or acid mixture and adjust the pH value with this acid or acid mixture. If the coating solution contains e.g. $Ce^{3+}$ and hydrogen peroxide, it is desirable to keep the solution at a pH value of about 2 in order to have a stable conversion coating solution. If the pH value is much above 2.5, RE compounds may oxidize to the Ce (IV) state and precipitate in the bath. If the pH value is much below 1.7, the formation of the conversion coating is slowed down or prevented.

The conversion coating solution contains substantially no chromate, that means, that there is no intentional addition of chromate or a chromium compound that may cause formation of $Cr^{6+}$ ions in solution. Normally, this means a chromate content of not more than 1 mg/l.

The conversion coating solution should contain minimum or no fluoride and/or phosphate content. The content of these anions is limited by the solubility limits of their Ce (III) salts. Both $CePO_4$ and $CeF_3$ are highly insoluble. Accordingly, any concentration of fluoride or phosphate species above a very low level results in the formation of a "sludge" of the cerium salts, thereby reducing the concentration of soluble cerium. Nevertheless, at least a small content of fluoride and/or phosphate usually does not affect the process of the invention. Therefore, the solution may be essentially free of fluoride and/or phosphate added to the solution as there has not been any intentional addition of these anions. In many cases, the fluoride and/or the phosphate content will therefore be less than 20 mg/l.

It is typically necessary for the coating solution to contain at least a small quantity of chloride, especially if the metal being treated is aluminium or an aluminium alloy. If present, the content of chloride in the conversion coating solution should preferably be at least 30 mg/l, such as at least 50 mg/l, more preferably at least 100 mg/l of chloride, particularly preferred at least 200 mg/l. The chloride content is not limited to high levels, but a minimum chloride content is generally needed, particularly for coating Al or Al alloy, and especially when the coating solutions contains Bi, otherwise the formation of the conversion coating would be too slow or prevented. Therefore, in many cases, a chloride content of 2 or 11 g/l does not impede the process of the invention with the exception that stainless steel will be adversely affected by solutions with a chloride content of more than 2 g/l. On the other hand, it may be quite sufficient in some cases to use the process of the invention with a chloride content of e.g. 400 mg/l which means that the corrosion rate of the stainless steel containers holding the conversion coating solution is nearly zero. The corrosion rate for stainless steel increases with the chloride content of the solution standing in contact with the stainless steel. Therefore, if corrosion of stainless steel containers is a consideration, it is preferred to work with a solution of a chloride content in the range of 150 to 800 mg/l.

The present inventors have discovered that in using the process of WO 96/15292 there has to be an increase of the chloride content during the treatment of metallic surfaces e.g. of an aluminum alloy starting from e.g. 3.5 g/l chloride continuously to higher chloride contents the more aluminum alloy surfaces have been treated. This relatively high chloride content can cause a significant corrosion of stainless steel containers.

The inventors have found that, contrary to the process of WO 96/15292, the process according to the present invention does not necessarily need a relatively high content of chloride and furthermore does not necessarily need an increase in the chloride content for the ongoing treatment of surfaces e.g. of an aluminum alloy. Therefore, if desired, one may keep the chloride content of solution at about the same low level for the duration of the coating process. There may, however, be the need to add a small amount of chloride after e.g. two weeks of work in order to maintain about the same level of chloride content and to adjust the pH value level of the bath e.g. with sulphuric acid within short intervals. In this manner, there does not occur any local corrosion attack on the surfaces of the stainless steel walls which might be used for tanks or other equipment.

If the metallic surface being coated is of magnesium, zinc or one of their alloys, the process does not require an upper limit for the nitrate content in the coating solution. If the surface is, however, of aluminum or one of its alloys, the nitrate concentration in the treatment solution should preferably not exceed 500 mg/l, more preferably 300 mg/l, particularly preferred 50 mg/l.

The conversion coating solution may additionally contain a surfactant, a biocide, a stabilizer for the peroxidic compound and/or at least one of the metals which are contained in the surface layer of the metallic part. Of course, there may be added other agents such as a foaming or an antifoaming agent.

The surfactant should be preferably in an amount effective to lower the surface tension of the solution and to facilitate the wetting of the metallic surface. The inclusion of a surfactant is beneficial in that by reducing surface tension of the solution, it thereby minimizes "drag-out" from the solution. "Drag-out" is an excess portion of coating solution which adheres to the metal and is removed from the solution with the metallic material and subsequently lost. Accordingly, there is less waste and costs are minimized by adding surfactant to the solution. A surfactant may also help to reduce cracking in the coating. The surfactant may be present in the solution at a concentration up to 0.1%, such as 0.01%.

The conversion coating solution may additionally contain stabilizers for hydrogen peroxide or any other peroxidic compound. Such stabilizers may enter the coating solution via the stabilizer content in the commercially available peroxide, or such stabilizers may be added intentionally to the coating solution. Compounds described in the literature as stabilizers for hydrogen peroxide include propionic acid, dipropylene glycol, ammonium nitrate, sodium stannate, sodium pyrophosphate, and phosphoric acid. One or more of the compounds used as stabilisers, however, may be partially or fully removed from the coating solution by interaction with Ce(III) cations, acid or the peroxidic compound.

At least one of the cations of the chemical elements in the conversion coating solution may be introduced into solution by dissolution of the corresponding metal present in the surface layer of the metal being coated. It may be advantageous to add an additional amount of these cations to a certain amount to shorten the period of time for reaching a virtually steady-state working condition.

The conversion coating solution is used at a solution temperature below the boiling temperature of the solution. The solution temperature is typically below 100° C., such as below 75° C. Preferably, the upper temperature limit is 60° C., such as up to 55° C. In some embodiments, the preferred upper temperature limit is 50° C. The lower temperature limit of the solution may be at about 0° C., although it is preferably in the range of 18° C. up to 45° C. More preferably, the solution temperature is not less than 35° C. If the temperature of the solution is higher, especially above 75° C., a boehmite coating may be formed on aluminum containing metallic surfaces which is not necessary for this invention, but which on the other hand does not affect it. Preferably, there is essentially no formation of boehmite upon the surface of the metallic part. Increasing temperature will also increase the decomposition of the peroxidic compound. With $H_2O_2$ at temperatures above 65° C., the decomposition is very fast.

Relatively higher concentration coating solutions are required when using short treatment times, such as in coil coating processes. The coated coil may be additionally treated either before or after the conversion coating step, with another corrosion inhibiting substance, such as with a passivation pretreatment, or with a primer or a paint.

The conversion coating may be applied by any known process for forming a coating from an aqueous solution. Typical methods of contacting a metallic substrate with a solution are immersing (=dipping), spraying, roll-coating or swabbing. In the case of coating a metallic coil, the coating solution may also be dried on or "squeegeed", such as by using roll-coater.

The conversion coating formed shows a good adhesion to the metal and provides good corrosion protection. A lubricant may be applied on to the conversion coating. Alternatively, it may be preferred to apply a sealing (final rinse) onto the conversion coating, and/or if wanted a paint film. The conversion coating is an excellent paint base, providing adhesion of the paint film to the metal and safeguarding and enhancing the corrosion protection of the paint film.

The weight of the conversion coating depends primarily on the thickness and structure of the coating as well as of the densities of the compounds and chemical elements precipitated. The thickness itself depends for example, on the duration of treatment. If the coating is too thin, it may result in the main element of the metallic surface being precipitated in a relatively high amount, such as aluminum as a hydroxide or oxide upon a surface of aluminum or an aluminum alloy. This precipitation may affect the properties of the conversion coating, On the other hand, if the coating is too thick, there may be a decrease of the adherence of the coating on the surface of the metallic part.

The coating weight may range of from 0.01 to 100 $g/m^2$, preferably of from 0.05 to 5 $g/m^2$. If intended as a paint base, the especially preferred coating weight is of from 0.1 to 3 $g/m^2$; if no further paint film is applied, the especially preferred coating weight is of from 0.4 to 10 $g/m^2$.

The density of the coatings is unknown, however it is estimated to be in the range of 2 to 5 $g/cm^3$. Assuming a value of 3 $g/m^3$, the corresponding coating thickness would range preferably of from 3 nm to 33 $\mu$m, particularly preferred of from 17 nm to 1.7 $\mu$m and especially preferred from 0.033 to 1.0 $\mu$m, when intended as a paint base; or particularly preferred of from 0.13 to 3.33 $\mu$m, if no paint film is to be applied thereon.

The coating weight is determined by stripping the coating in a suitable stripping solution and taking the weight difference before and after the removal. A suitable stripping solution for aluminum and its alloys is e.g. a 15% nitric acid solution in water.

The determination of the coating thickness usually is more complicated. Methods which rely on a probe touching the surface will be compromised by the indention that the probe invariably makes, producing a good cross cut for a microscopic measurement is very cumbersome. Below 50 $mg/m^2$ of coating weight, the preferred method for determining 'coating weight' is by X-ray fluorescence for the REE, or a micro probe, as the weigh-strip-weigh-method becomes increasingly less accurate.

The mean particle size of the grains or crystals of the formed conversion coating may be in the range of up to 5 $\mu$m just after formation, preferably in the range of from 0.1 to 1.5 $\mu$m. The mean particle size may be measured on photographs taken with a scanning electron microscope from the surface of the conversion coating. In many cases, the coating displays a more gel-like morphology so that no crystals can be identified just after formation.

It is preferred that the coating is dense and homogeneous, as could be detected with the aid e.g. Of a light or scanning electron microscope.

The content of REE compounds in the coating may vary in broad ranges e.g. In the range of from 5 to 99.9% by weight. Nevertheless, it is preferred to have a content of REE in the range of from 20 to 92% by weight, particularly preferred in the range of from 50 to 88% by weight, especially preferred in the range of from 60 to 85% by weight. Furthermore, the content of cerium in the total REE may vary in broad ranges, too. Nevertheless, it is preferred to have an amount of a cerium containing compound in the range of from 3 to 99.9% by weight, particularly preferred in the range of from 30 to 99.8% by weight. In many cases, the content of the cerium containing compound may vary from 60 to 99% by weight.

The conversion coating may include an amount of at least one element or compound containing the metal from Groups VA and VIA. While this element is present in the coating solution, it is not always detectable in the conversion coating formed from the solution. Where that element is Bi, typically the content of Bi or a Bi compound (if detectable) in the coating may be in the range of from 1 to 60 $mg/m^2$ in many cases.

The formed conversion coating is preferably colored to distinguish a treated from an untreated surface, unless the conversion coating is too thin. The color is preferably yellowish, yellow, or orange, as this is the well accepted color of chromate coatings. The conversion coatings may be so thin that the metallic luster of the metal, its grain structure, and/or the structure resulting from the e.g. rolling process can be seen through the coating. In any case, the color of the coating may be a helpful characteristic to control the quality of the coating, unless the coating is colorless. The color may be caused by a high content of $Ce^{4+}$. On the other hand, certain amounts of other coloring REE ions may be chosen to generate a colored conversion coating. Such REE chosen for the conversion coating may be Pr, Nd, Sm, Eu, Dy, Ho, Er, and Tm and/or their mixtures.

After the formation of the conversion coating on the metallic substrate, a lubricant, a sealant and/or a paint may be applied onto the conversion coating. There may be applied combinations of a sealant and a lubricant or of a sealant and a paint. These process steps are generally well known. If a sealant step is used, preferably the coated metallic surface is rinsed prior to and sometimes also after the sealing process. The conversion coating may be sealed by treatment with at least one of a variety of aqueous or non-aqueous inorganic, organic or mixed sealing solutions. The sealing solution may contain alkali silicates, borates, $Cr^{3+}$ containing salts, Al and Zr fluorides, phosphates, silanes, polyacrylates and/or their derivatives, polyvinylphenole derivatives and/or other polymers. The sealing solution forms a surface layer on the conversion coating and may further enhance the corrosion resistance of the conversion coating. A similar effect may be gained with a painting step.

The metallic material of construction of the surface treated part may primarily be another or the same material as the material at the surface. The metallic material of construction may be e.g. steel carrying a coating of zinc or of a zinc alloy. On the other hand, the metallic material of construction of the surface treated part may be e.g. an aluminum alloy of the series 7000 which does not carry any metallic coating so that its surface is of this alloy. Preferably, the metallic material at the surface is aluminum or an aluminum alloy, preferably an aluminum alloy of the series 3000, 5000 or 6000. Its conversion coating may contain at least 5% by weight of cerium and may contain at least traces of at least one element of Groups VA and VIA and/or their compounds.

The liquid acidic aqueous concentrate for the makeup of a conversion coating solution for forming a conversion coating on the surface of the metallic material contains preferably at least 100 g/l of total REE, particularly preferred at least 125 g/l. It may contain at least one element of Groups VA and VIA. Preferably, at least one of the REE containing compounds is a cerium compound.

The conversion coating solution may be typically produced by mixing a concentrate for the makeup of a conversion coating solution with water and at least one peroxidic compound. The solution may be diluted preferably by a factor of from 5:1 to 25:1 of water:concentrate, particularly preferred in the range of from 8:1 to 15:1.

The water used in the process should preferably be of high purity. Deionized water is especially preferred. However, tap water, unless of high hardness, may often be acceptable as well.

Preferably the coating solution is produced by using as peroxidic compound a solution of hydrogen peroxide, usually stabilized. The preferred concentration is approximately 35% by weight, which is commercially available, or 19% by weight, which considerably reduces the risk during handling. Although concentrations of 50% by weight and higher are commercially available, such concentrations must not be used, as there is an increasing, risk of explosive decomposition of the hydrogen peroxide, especially when coming into contact with contaminants.

The liquid acidic aqueous concentrate for the replenishing of a conversion coating solution for forming a conversion coating on the surface of the metallic material may contain REE ions and monovalent anions in a molar ratio of total REE ions:monovalent anions of from 1:200 to 1:6.

The liquid acidic aqueous concentrate for the replenishing of a conversion coating solution for forming a conversion coating on the surface of a metallic material may contain REE ions and divalent anions in a molar ratio of total REE ions:divalent anions of from 1:100 to 1:3.

The liquid acidic aqueous concentrate for the replenishing of a conversion coating solution for forming a conversion coating on the surface of a metallic material may contain one or more metals selected from Groups VA and VIA such that the molar ratio of total metals from Groups VA and VIA-:monovalent anions is in the range 1:100 to 1:20000 or the molar ratio of total metals from Groups VA and VIA:divalent anions is in the range 1:50 to 1:10,000.

Preferably, the concentrate also contains at least one peroxidic compound.

The conversion coating solution can be used for treating a large number of parts—in fact the ratio of surface area treated and bath volume may well exceed 2 $m^2$/l, if all substances whose concentration have decreased by the conversion coating process are replenished. Such a decrease may result from forming the conversion coating itself, from dissolving part of the metal surface, from precipitation in the bath, from intentionally or unintentionally overflowing the conversion coating solution, from decomposition or from drag-out. It is preferred to replenish the coating solution using the concentrate for replenishing and an additional solution containing a peroxidic compound, preferably one of the preferred hydrogen peroxide solutions described above. Of course, water lost due to evaporation must be replenished as well.

The aqueous, acidic solution for forming a conversion coating on the surface of a metallic material preferably of the group of aluminum, aluminum alloy, magnesium, magnesium alloy, zinc and zinc alloy, may contain ions and/or complex species of metals from Groups VA and VIA. It may contain ions and/or complex species of a mixture of rare earth elements, whereby the ratio of cerium to total rare earth elements is at least 5% by weight. Furthermore, the solution may contain ions and/or complex species of bismuth, preferably complex species.

In one preferred embodiment, the accelerator additive is Bi, present in the coating solution as a complexed species (such as Bi-HEDTA) at a concentration of Bi of between 0.05 to 1 mmol/liter. At such concentrations of Bi, a good, adherent, uniform, non-powdery coating will form on the metallic surface with substantially no loss of Bi from solution. However, if solutions are used having a concentration of Bi above such levels, a sludge, which can contain Bi, may form in the coating solution, with consequential decrease in Bi concentration in solution. Typically, however, coatings can still be formed using such a solution. The coating solution used in the above process preferably also contains hydrogen peroxide in a range of from 15 to 30 g/l and a chloride content of at least 50 mg/l.

EXAMPLES

The following examples illustrate, in detail, embodiments of the invention. The following examples shall help to clarify the invention, but they are not intended to restrict its scope:

Substrates

1. Magnesium alloy AZ91, sized 100*100*4 mm,
2. Aluminum magnesium alloy AA 5005, cold rolled, sized 100*100*0.7 mm,
3. Aluminum silicon magnesium alloy AA 6063, flat extruded profile, sized 100*80*3.5 mm,
4. Hot dip galvanized steel, cold rolled steel, 15 $\mu$m zinc layer, minimal spangle, sized 105*190*0.7 mm.

Process

The parts were conversion coated using a standard process sequence for pre-treatment and after-treatment (See Table 1). The cleaning is done with an aqueous, non-etching, silicate-free alkaline cleaner, Gardoclean® T 5374 of Chemetall GmbH; the pH of the bath solution was 10 after make-up. As a deoxidizer for these alloys, which contain small amounts of copper only, a hydrofluoric/phosphoric acid mixture, Gardacid® AL of Chemetall was used at a total concentration of 1.25 mol/l of free acid. The coating was done by immersion, unless otherwise noted. Gardacid®, Gardobond®, and Gardoclean® are registered trademarks of Chemetall GmbH, Frankfurt am Main, Germany.

TABLE I

Process Sequence

| Step | Process | Chemicals, Equipment | Concentration [g/l] | Temp. [° C.] | Time [sec] |
|---|---|---|---|---|---|
| 1 | Alkaline cleaning | Gardoclean ® T 5374 | 40 | 60 | 300 |
| 2 | Rinsing | Water | | Ambient | 30 |
| 3 | Deoxidizing (for aluminum alloys only) | Gardacid ® AL | 57 Gardacid AL5<br>22 Gardacid AL6 | Ambient | 180 |
| 4 | Rinsing (for aluminum alloys only) | Water | | Ambient | 30 |
| 5 | Rinsing | De-ionized water | | Ambient | 30 |
| 6 | Conversion Coating | See specific examples | | 45 | 150 |
| 7 | Rinsing | Water | | Ambient | 30 |
| 8 | Final Rinsing | De-ionized water | | Ambient | 30 |
| 9 | Drying | Oven | | 80 | 600 |

Solutions

Comparative Example A

Chromate-based Conversion Coating

The conversion coating solution was prepared by dissolving 31 g/l of Gardobond® C 720 and 0.9 g/l $K_3[Fe(CN)_6]$ in deionized water. This corresponds to a chromic acid concentration of 4.5 g/l.

Comparative Example B

Non-accelerated Cerium-based Conversion Coating

A conversion coating solution as disclosed by Wilson et al. In WO 88/06639 was prepared by dissolving in de-ionized water 15 g/l $CeCl_3.7H_2O$, corresponding to 5.6 g/l $Ce^{+++}$, 25 g/l $H_2O_2$ and hydrochloric acid to adjust the pH to 2.2.

Comparative Example C

Accelerated Cerium-based Conversion Coating

A conversion coating solution as disclosed by Hughes et al. In WO 96/15292 was prepared by dissolving in de-ionized water 13.2 g/l $CeCl_3.7H_2O$, corresponding to 5 g/l $CA^{+++}$, 3.0 g/l $H_2O_2$, 60.0 mg/l $Cu^{++}$, added as $CuCl_2.2H_2O$, 0.1 g/l titanium as Ti-peroxo-complex, prepared by reacting $TiCl_4$ in 35% $H_2O_2$ solution, and hydrochloric acid to adjust pH to 2.0.

Examples According to the Invention

The pH value of all solutions was 2.0–2.1. The acid corresponding to the anion given in Table II was used for adjusting the pH. Except for Examples 5 and 6, no other anions were introduced into the solution.

Cerium salts were prepared by dissolving cerium carbonate in the appropriate acids. Accordingly, cerium (III) chloride, cerium (III) sulphate, cerium (III) sulphamate, cerium (III) nitrate, cerium (III) perchlorate and cerium (III) methanesulphonate were formed by dissolving cerium carbonate in hydrochloric acid, sulphuric acid, sulphamic acid, nitric acid, perchloric acid and methanesulphonic acid, respectively.

In order to form the accelerator additive, bismuth (III)-oxide or antimony (III)-oxide were dissolved in the appropriate acids in the presence of the complexant—except for Example 1 where no complexant was used, and the necessary quantity of accelerator was added to the conversion coating solution.

TABLE II

Conversion coating solutions according to the invention

| | Ce | $H_2O_2$ | Accelerator | | Complexant | | |
|---|---|---|---|---|---|---|---|
| Ex. | [mol/l] | [mol/l] | Type | [mmol/l] | Type | [mmol/l] | Anion |
| 1 | 0.05 | 0.3 | $Bi^{+++}$ | 0.3 | None | 0 | chloride |
| 2 | 0.05 | 0.3 | $Bi^{+++}$ | 0.3 | EDTA | 0.35 | chloride |
| 3 | 0.15 | 0.8 | $Bi^{+++}$ | 0.15 | HEDTA | 0.2 | chloride |
| 4 | 0.15 | 0.3 | $Bi^{+++}$ | 0.1 | NTA | 0.3 | chloride |
| 5 | 0.05 | 0.6 | $Bi^{+++}$ | 0.05 | EDTA | 0.07 | sulphamate[1] |
| 6 | 0.1 | 0.6 | $Sb^{+++}$ | 1.0 | Tartrate | 2.0 | sulphate[2] |
| 7 | 0.025 | 0.15 | $Bi^{+++}$ | 0.05 | EDTA | 0.06 | nitrate |

[1]The solution contained additionally 300 to 450 mg/l of chloride, added to the solution in the form of HCl.
[2]The solution contained approximately 150 mg/l chloride derived from occluded chloride in the source cerium carbonate.

Results

The test specimens were treated according to the process specified in Table I using the solutions A, B, and C for the comparative examples and the solutions 1 to 7 (Table II) for the Examples according to the invention. The coating was judged for color, for complete coverage, and for uniformity. The coating weight was determined by the weight difference before and after stripping the coating with 15% nitric acid. Some coatings were also analyzed for the cerium content by X-ray fluorescence analysis using samples for calibration of the same alloys with a known cerium content on the surface.

A number of parts were painted with a polyester powder paint such as is commonly used for outdoor architectural profiles. The painted parts were subjected to adhesion testing by Cross Hatch according to DIN ISO 2409 and to accelerated corrosion testing in the Salt Spray Test ESS DIN 50 021 (Acetic Acid Enhanced) and CASS DIN 50 021 (Copper-Acetic Acid enhanced).

Solution and Coating Quality

Comparative Example A

The substrates 2 and 3 (AA 5005 and AA 6063) were treated. Within 90 sec a visible coating appeared during immersion of the parts in the chromating solution. After the specified time the coating was uniform, completely covering the surface and the edges of the part, and bright yellow. The coating weight was 540 and 620 mg/m$^2$ for the AA5005 and AA 6063 parts, respectively.

Comparative Example B

The substrates 2 and 3 (AA 5005 and AA 6063) were treated. No coating was formed on either alloy. Changing conditions of cleaning, deoxidation, and of immersion time as well as of temperature in the conversion-coating step did not produce any visible coating, although some reaction was indicated by the effervescence of the solutions during the immersion of the parts. The treatment time was explored well beyond any reasonable length for an industrial setting, yet even 30 min did not provide an acceptable result. The decomposition of peroxide was below 2% in 24 h while standing at 45° C.

Comparative Example C

The substrates 2 and 3 (AA 5005 and AA 6063) were treated. A yellow coating developed on the parts with a coating weight of 340 and 450 mg/m$^2$ on AA 5005 and AA 6063, respectively. The coating was yellow, slightly non-uniform. There was some tendency towards streaking. The coverage was complete. The decomposition of peroxide was 25% in 24 h while standing at 45° C.

Example 1

The substrate 3 (AA 6063) was treated. Treating the specimen immediately after preparing the solution, a light yellow coating was produced on AA 6063. The coating weight was 130 mg/m$^2$. The adhesion of the conversion coating was tested with an adhesive tape. After pulling the tape off, only very slight traces of the coating could be seen after the tape was put onto white paper. Within 10 minutes, a precipitate formed in the solution which was later analyzed to contain most of the bismuth originally present. Treating another part of AA 6063 did not result in an acceptable coating. The decomposition of peroxide was below 2% in 24 h while standing at 45° C.

Example 2

The substrates 2 and 3 (AA 5005 and AA 6063) were treated. A uniform, yellow coating with a tint of orange developed on both alloys; the coating weight was 440 and 650 mg/m$^2$ for AA 5005 and AA 6063, respectively. The adhesion of the conversion coating was tested with an adhesive tape: After pulling the tape off, only very slight traces could be seen after the tape was put onto white paper. The cerium content of the coating was 30 and 25% by weight, respectively. There were a few shallow spots of local attack visible on the AA 5005 alloy with approximate dimensions of 2 $\mu$m. No precipitate formed in the bath solution after standing at 45° C. for 24 h. The decomposition of peroxide was below 2% in 24 h while standing at 45° C.

Example 3

The substrates 2 and 3 (AA 5005 and AA 6063) were treated. A uniform, yellow-orange coating developed on both alloys; the coating weight was 1160 and 730 mg/m$^2$ for AA 5005 and AA 6063, respectively. The adhesion of the conversion coating was tested with an adhesive tape. After pulling the tape off, only very slight traces could be seen after the tape was put onto white paper. The cerium content of the coating was 55 and 77% by weight, respectively. There were very few shallow spots of local attack visible on the AA 5005 alloy with approximate dimensions of 2 μm. No precipitate formed in the bath solution after standing at 45° C. for 24 h. The decomposition of peroxide was below 2% in 24 h while standing at 45° C.

Example 4

The substrates 2 and 3 (AA 5005 and AA 6063) were treated. A uniform, yellow coating with a strong tint of orange developed on both alloys; the coating weight was 610 and 495 mg/m$^2$ for AA 5005 and AA 6063, respectively. The adhesion of the conversion coating was tested with an adhesive tape: After pulling off, only very slight traces could be seen after the tape was put onto white paper. The cerium content of the coating was 60 and 47% by weight, respectively. There were a few shallow spots of local attack visible on the AA 5005 alloy with approximate dimensions of 2 μm. No precipitate formed in the bath solution after standing at 45°C. for 8 h; after 24 h at 45° C., however, a slight precipitate formed reducing the soluble bismuth-concentration by approximately half. The decomposition of peroxide was below 2% in 24 h while standing at 45° C.

Example 5

The substrates 2 and 3 (AA 5005 and AA 6063) were treated. A uniform, light yellow coating developed on both alloys; the coating weight was 240 and 190 mg/m$^2$ for AA 5005 and AA 6063, respectively. The adhesion of the conversion coating was tested with an adhesive tape: After pulling off, only very slight traces could be seen after the tape was put onto white paper. The cerium content of the coating was 25 and 35% by weight, respectively. No precipitate formed in the bath solution after standing at 45° C. for 24 h. The decomposition of peroxide was below 2% in 24 h while standing at 45° C.

Example 6

The substrates 2 and 3 (AA 5005 and AA 6063) were treated. A non-uniform, light yellow coating developed on both alloys; the coating weight was 100 and 110 mg/m$^2$ for AA 5005 and AA 6063, respectively. The adhesion of the conversion coating was tested with an adhesive tape: After pulling off, only very slight traces could be seen after the tape was put onto white paper. The cerium content of the coating was 15 and 12% by weight, respectively. A precipitate formed in the bath solution after standing at 45° C. for 6 h. After this precipitation, neither was there any soluble Sb detectable, nor did a coating develop when using the solution for forming the conversion coating. The decomposition of peroxide was below 2% in 24 h while standing at 45° C.

Example 7

The substrates 1 and 4 (AZ 91 and hot dip galvanized steel [hdg]) were treated. The conversion coating solution was applied by spraying for 50 sec at 40° C. at a spraying pressure of 1.0 bar with a full-cone nozzle. The other process steps were done by immersion. On both kinds of substrates, a uniform, yellow coating developed. The coating weight was 460 and 600 mg/m$^2$ for AZ 91 and hdg, respectively. The adhesion of the conversion coating was tested with an adhesive tape: After pulling off, only very slight traces could be seen after the tape was put onto white paper. The decomposition of peroxide was below 2% in 24 h while standing at 45° C.

Paint Results 2 specimens each of the AA 6063 alloy underwent testing after painting. 2 specimens of AZ 91 of Example 7 were also painted. The results are presented in Table III.

TABLE III

Adhesion Tests

| EXAMPLE | | Cross Hatch | ESS 1000 h | ESS 2000 h | CASS 1000 h |
|---|---|---|---|---|---|
| A | comparative | 0 | <1 mm | <1 mm | <1 mm |
| B | comparative | 1–2 | 1 mm | 4 mm | 5 mm |
| C | comparative | 0 | <1 mm | 1 mm | 1 mm |
| 2 | invention | 0 | <1 mm | 1 mm | 1 mm |
| 3 | invention | 0 | <1 mm | 1 mm | 1 mm |
| 4 | invention | 0 | <1 mm | 1 mm | 1 mm |
| 5 | invention | 0 | <1 mm | 1.5 mm | 1.5 mm |
| 6 | invention | 1 | 1 mm | 1.5 mm | 2 mm |
| 7 | invention | 0 | not done | not done | not done |

The rating for the Cross Hatch Test is from

0: 'No cracking and delamination of the paint along the cuts' to

4: 'Complete removal of the paint'.

The creepage of the ESS Test is from the scribe to one side.

The results of the corrosion and adhesion tests show that the quality standards set by chromating aluminum are also met by the treatment according to the invention, which will allow the replacement of carcinogenic, toxic chemicals by chemicals which are not more than corrosive.

Concentrates

Example 8

A liquid make-up concentrate was made by the following method:

0.67 g $Bi_2O_3$ and 1.02 g EDTA (as acid) were dissolved in 100 ml of 1 molar HCl solution. A slightly turbid solution results, which, after filtration, was added to a solution of 400 g $CeCl_3.7H_2O$ in 0.4 l de-ionized water, and finally the weight was adjusted with deionized water to 1 kg.

A clear, colorless solution resulted. It was stable for at least 6 weeks at 50° C.

Example 9

A liquid concentrate for replenishing was made up by the following method:

0.50 g $Bi_2O_3$ and 0.76 g EDTA (as acid) were dissolved in 100 ml of 1 molar HCl solution. A slightly turbid solution resulted, which, after filtration, was added to a solution of 225 g $CeCl_3.7H_2O$ in 497 g of 35% by weight of hydrochloric acid, and finally the weight was adjusted with de-ionized water to 1 kg.

Throughput

Example 10

A processing line was set up in the laboratory consisting of glass beakers of 2 l each according to the processing steps of Table I. The conversion coating solution was prepared by adding 200 g of a liquid make-up concentrate solution to de-ionized water. This solution contained:

| | |
|---|---|
| Ce | 15 g/l |
| Bi | 60 mg/l |
| EDTA | 102 mg/l |

at a pH value of 1.95. 20 g/l of hydrogen peroxide were added. A large number of AA 6063 panels with a total surface area of 4 $m^2$ were processed by immersing through the line on 3 consecutive days, using treatment times and temperatures as given in Table I. The solutions were allowed to cool overnight. Before resuming work and after having treated 5 panels, the pH value was regularly measured, and the peroxide concentration was determined by titration with potassium permanganate solution. The replenishing solution was added to adjust the pH value to between 1.95 and 2.05, and a solution of 35% by weight of $H_2O_2$ was added to keep the concentration of $H_2O_2$ in the range of from 17 to 21 g/l.

Uniform, yellow coatings were formed. The coating weights varied from initially 1000 mg/$m^2$ to about 500 mg/$m^2$ at the end of the throughput The latter value was still acceptable. The peroxide decomposition was about 0.5% in the first night (about 16 hours) and about 1.5% in the second night. The final solution was analyzed. It contained at a pH value of 2.0:

| | |
|---|---|
| Ce | 13.3 g/l |
| Bi | 40 mg/l |
| EDTA | 150 mg/l |
| $Al^{+++}$ | 5.3 g/l |
| $Cu^{++}$ | 2 mg/l |
| $Fe^{+++}$ | 1 mg/l |
| $Cl^-$ | 30.8 g/l |
| $H_2O_2$ | 18.5 g/l |

Finally, it is to be understood that various alterations, modifications and/or additions may be introduced into the constructions and arrangements of parts previously described without departing from the spirit or ambit of the invention.

What is claimed is:

1. An aqueous acidic solution for forming a rare earth element containing conversion coating on the surface of a metal, said solution being substantially chromate-free and including at least one rare earth element containing species, an oxidant and at least one accelerator comprising a metal selected from Groups VA and VIA of the Periodic Table, wherein said rare earth element containing species, oxidant and accelerator are present in quantities effective to form said conversion coating.

2. The solution of claim 1, further including a chloride containing species, such that the concentration of chloride in solution is at least 30 mg/l, preferably at least 50 mg/l.

3. The solution of claim 1, wherein the solution contains ions and/or complexes of a mixture of rare earth elements, wherein the ratio of cerium to total rare earth elements is at least 5% by weight, and the total concentration of rare earth elements is preferably in the range from 0.5 to 1000 g/l, more preferably from 0.5 to 100 g/l, more preferably from 1 to 60 g/l, particularly preferably from 2 to 30 g/l.

4. The solution of claim 1, wherein the rare earth element is cerium, preferably introduced into the solution in the form of a soluble salt, such as a cerium (III) containing chloride, cerium (III) containing sulphate, cerium (III) containing sulphamate, cerium (III) containing methanesulphonate, cerium (III) containing perchlorate or cerium (III) containing nitrate, preferably, said soluble salt is formed by reaction of cerium carbonate with an appropriate acid.

5. The solution of claim 1, wherein the Group VA metal is selected from Sb or Bi and the Group VIA element is selected from Se or Te.

6. The solution of claim 1, wherein the accelerator is Sb or Bi, preferably Bi, more preferably present at a concentration between 0.01 and 20 mmol/l.

7. The solution of claim 1, wherein the concentration of said metal selected from Groups VA and VIA of the Periodic Table is in the range from 0.001 to 1 g/l, preferably 0.005 to 0.2 g/l, more preferably from 0.005 to 0.1 g/l, more preferably from 0.01 to 0.1 g/l, more preferably from 0.01 to 0.06 g/l.

8. The solution of claim 1 containing only one metal selected from Groups VA and VIA.

9. The solution of claim 1, wherein the accelerator comprises Bi present in a concentration range up to 50 mmol/liter, preferably 0.001 to 20 mmol/l, more preferably from 0.02 to 5 mmol/liter, more preferably from 0.1 to 0.5 mmol/l, even more preferably from 0.05 to 0.3 mmol/l.

10. The solution of claim 1, wherein said oxidant is a peroxo containing species selected from the group consisting of peroxo acids, peroxo acid salts and peroxo compounds, preferably hydrogen peroxide.

11. The solution of claim 10, wherein said peroxo containing species is present at a concentration up to 10 mol/liter, preferably from 0.01 to 6 mol/liter, more preferably from 0.03 to 3 mol/liter, more preferably from 0.1 to 1 mol/liter.

12. The solution of claim 1, further including complexes between said one or more elements selected from Groups VA and VIA and at least one complexing agent, said complexing agent preferably selected from the group consisting of amino carboxylic acids, more preferably polyamino carboxylic acids, and salts thereof.

13. The solution of claim 12, wherein said complexing agent is selected from the group consisting of ethylenediaminetetraacetic acid (EDTA), nitrilotriacetic acid (NTA), hydroxyethylethylenediaminetriacetic acid (HEDTA) and salts thereof.

14. The solution of claim 12, wherein the concentration of said complexes is 50 mmol/liter or less, preferably in the range from 0.01 to 20 mmol/liter.

15. The solution of claim 12, wherein the complexing agent is EDTA and/or HEDTA and the molar ratio of complexing agent: metal of Group VA or VIA is from 4:1 to 0.8:1, preferably from 2:1 to 0.9:1, more preferably about 1:1.

16. The solution of claim 12, wherein the complexing agent is NTA and the molar ratio of complexing agent: metal of Group VA or VIA is from 8:1 to 1:1, such as from 8:1 to 2:1, preferably from 4:1 to 2.4:1, such as from 4:1 to 1.5:1, more preferably about 3:1, even more preferably about 2:1.

17. The solution of claim 1, having no or minimal amounts of each of Cu, Fe, Ni and Co.

18. The solution of claim 1, having a pH value of from 1.0 to 2.9, preferably from 1.7 to 2.5, more preferably from 1.8 to 2.2.

19. The solution of claim 18, wherein the pH value of the solution is adjusted by addition of at least one acid selected from the group consisting of mineral acids, carboxylic acids, sulphonic acids and phosphonic acids, preferably selected from the group consisting of hydrochloric acid, sulphuric acid, sulphamic acid, methanesulphonic acid, nitric acid and perchloric acid, more preferably said acid is hydrochloric acid.

20. The solution of claim 1, wherein said solution is substantially free of fluoride and/or phosphate, preferably less than 20 mg/liter of each.

21. The solution of claim 1, wherein said solution includes from 0.01 to 0.5 mol/liter of cerium ions, preferably present in solution as cerium chloride.

22. A liquid acidic aqueous concentrate for the make-un of an aqueous acidic solution of claim 1, said concentrate including at least 125 g/l of the total rare earth element containing species, at least one acid selected from the group of mineral acids, carboxylic acids, sulphonic acids and phosphonic acids, and at least one metal from Groups VA and VIA of the Periodic Table, wherein the concentrate contains substantially no chromate, minimal or no phosphate and minimal or no fluoride.

23. A liquid acidic aqueous concentrate for the replenishing of a conversion coating solution of claim 1, said concentrate including one or more metals selected from Groups VA and VIA such that the molar ratio of total metals from Groups VA and VIA: monovalent anions is in the range 1:100 to 1:20000 or the molar ratio of total metals from Groups VA and VIA: divalent anions is in the range 1:50 to 1:10000.

* * * * *